US005167730A

United States Patent [19]

Kaiser

[11] Patent Number: 5,167,730

[45] Date of Patent: Dec. 1, 1992

[54] METHOD FOR APPLYING TELLURIUM-CONTAINING COATINGS TO METALLIC SURFACES USING CYCLODEXTRINS/TELLURIUM COMPOSITIONS

[75] Inventor: Herbert J. Kaiser, St. Louis, Mo.

[73] Assignee: Calgon Corporation, Pittsburgh, Pa.

[21] Appl. No.: 775,889

[22] Filed: Oct. 15, 1991

[51] Int. Cl.[5] ..... C23C 22/00

[52] U.S. Cl. ..... 148/259; 148/270

[58] Field of Search ..... 148/259, 270, 266

[56] References Cited

U.S. PATENT DOCUMENTS 4,321,231 3/1982 Gupta ..... 148/270

*Primary Examiner*—Sam Silverberg

*Attorney, Agent, or Firm*—W. C. Mitchell; C. M. Caruso

[57] ABSTRACT

Improved tellurium-containing coating compositions and a method for applying a tellurium-containing coating to a metallic surface characterized by the presence of tellurium and a dextrin solubilizing agent.

8 Claims, No Drawings

METHOD FOR APPLYING TELLURIUM-CONTAINING COATINGS TO METALLIC SURFACES USING CYCLODEXTRINS/TELLURIUM COMPOSITIONS

BACKGROUND OF THE INVENTION

This invention relates to improved tellurium compositions and a method for applying tellurium coatings to metallic surfaces. These coating compositions are characterized by the presence of tellurium and a cyclodextrin solubilizing agent.

As used herein, the term "coating" refers to a material bonded to the surface of a metal which differs chemically from the metal itself. A particular example of a coating is a phosphate-based conversion coating. Such a coating is formed by chemical interaction between a phosphate-containing coating composition and the metal substrate being treated.

Conversion coatings are used to enhance the corrosion resistance of treated metal surfaces and to improve the adherence of paints and other coatings to these surfaces. As practiced in the art, conversion coatings are generally applied to metallic surfaces as iron phosphate, zinc phosphate or manganese phosphate. For example, a conversion coating may be produced by contacting a metal surface with a composition comprising a phosphate source, an acid and an accelerator. Typical accelerators used for this purpose include molybdenum, vanadium, nickel and tungsten salts.

Prior to application of a conversion coating, the metallic surface to be treated is generally cleaned to remove oil, grease, and other impurities. These impurities may act as mechanical barriers to conversion coating compositions or solutions, and can either interfere with or completely prevent adherence of the conversion coating to the metallic surface being treated.

After cleaning, the metallic surface is typically contacted with a conversion coating solution which comprises an acid, a phosphate source, an oxidizer and an accelerator. The surface is then generally rinsed with water to remove unreacted reagents and phosphate salts. Finally, a chromate, nitrate, or acid sealing rinse may be applied to the surface being treated, prior to painting.

Several disadvantages inherently plague conventional conversion coating methods, such as iron phosphate coating methods. Key among these is that iron phosphate processes generally produce coatings which provide less corrosion resistance than zinc phosphate coating processes. Since zinc phosphate processes are generally more complex and more costly to utilize, and are environmentally undesirable, there is a long-felt need in the art for a convenient, inexpensive method of providing corrosion-resistant conversion coatings. This need is met by the instant method and compositions.

It is therefore an object of this invention to provide improved tellurium compositions and an improved method for applying a uniform, durable tellurium coating to a metallic surface which provides corrosion resistance to the substrate being treated. This object is accomplished by utilizing tellurium coating compositions which contain a tellurium ion source and a solubilizing agent selected from the group consisting of cyclodextrins to form a coating characterized by the presence of tellurium. Any metallic surface can be treated according to the instant invention, including but not limited to galvanized surfaces, stainless steel surfaces, mild steel surfaces and aluminum surfaces.

This and other objects of the instant invention are accomplished by the instant compositions and the method disclosed herein. The instant coating compositions and method allow the application of uniform tellurium coatings to metallic surfaces, particularly in the mid-pH range. The method can be utilized at any temperature up to boiling, and the resulting coating provides corrosion resistance to the substrate. The instant coatings also generally improve the appearance of paints and other coatings subsequently applied to treated metallic surfaces.

The MERCK INDEX, Tenth Edition, discloses that tellurium is a reagent which produces a black finish on silverware.

U.S. Pat. No. 4,713,121 discloses phosphate conversion coatings which contain first and second divalent metal elements, such as cobalt and zinc.

U.S. Pat. No. 4,391,855 discloses a coating method which utilizes compositions containing a powdered metal dispersed in a bonding material as a corrosion inhibitor.

U.S. Pat. No. 4,149,909 discloses the use of chlorates and bromates as accelerators and hydroxylamine sulfate as a reducing agent in phosphatizing compositions used to produce iron phosphate coatings.

U.S. Pat. No. 4,595,424 discloses phosphate coating solutions for use on zinc surfaces which contain a phosphate ion source, a zinc and/or manganese ion source and a complex of fluoride ions.

U.S. Pat. No. 4,634,295 discloses a method for improving corrosion resistance of metal substrates which requires application of a direct current to a previously zinc-phosphated metal surface in an acidic solution containing zinc, phosphate and chloride ions.

Copending application U.S. Ser. No. 361,087 discloses tellurium compositions and methods for applying the same to metallic surfaces. Copending Application U.S. Ser. No. 722,740 discloses the use of cyclodextrins to solubilize tellurium.

SUMMARY OF THE INVENTION

This invention relates to improved tellurium coating compositions and to an improved method for applying a tellurium coating to a metallic surface, wherein the method and compositions are characterized by the use and/or presence of a tellurium ion source and a tellurium solubilizing agent selected from the group consisting of cyclodextrins.

DETAILED DESCRIPTION OF THE INVENTION

The instant invention is directed to a method for applying a coating to a metallic surface which comprises:

(A) contacting said metallic surface with an effective amount of an aqueous coating composition which comprises:
  a) water
  b) about 0.1 to about 100,000 ppm, based on the weight of a) of tellurium ions;
  c) about 0.1 to about 100,000 ppm, based on the weight of a) of a cyclodextrin;
  d) optionally, about 0.1 to about 400,000 ppm, based on the weight of a) of phosphate ions;

e) optionally, about 0.1 to about 200,000 ppm, based on the weight of a) of an oxidizer; and (B) optionally, rinsing and drying said metallic surface.

Relative to this method, the term "effective amount" refers to that quantity of coating composition necessary to provide intimate contact between the metal surface to be coated and the coating composition for a time adequate to allow a coating characterized by the presence of tellurium to bond to the metallic surface being treated.

In the instant water-based compositions, a cyclodextrin is used as a tellurium solubilizing agent. As disclosed in copending application U.S. Ser. No. 722,740, cyclodextrins solubilize tellurium over the entire pH range. This enables substrates to be coated using tellurium coating compositions in the mid pH range. Thus, the instant coating compositions may be formulated at a pH where tellurium is soluble. The pH of the coating compositions can then be adjusted to the mid-pH range so that the coating may be applied more conveniently and safely. As used herein, the term "mid-pH range" is from about 2.5 to about 11.0, preferably from about 3.0 to about 9.0.

The tellurium ion source provides the tellurium present in the coating formed on the substrate. Optionally, phosphate ion sources and/or oxidizers may be used. Phosphates and oxidizers facilitate preparation of the metallic substrate. One or more acids may also be present. Acids are believed to facilitate the bonding of the tellurium coating to the substrate. Hydrochloric acid and sulfuric acid are preferred.

Additionally, effective amounts of surfactants may be added for cleaning, penetration and/or wetting purposes, and an effective amount of a fluoride source may be added for use on galvanized or aluminum surfaces. Other conventional additives used in conversion compositions, such as chelants, may also be added.

The instant invention is also directed to compositions comprising:

a) water;

b) about 0.1 to about 400,000 ppm, based on the weight of a), of phosphate ions;

c) about 0.1 to about 100,000 ppm, based on the weight of a), of a tellurium; ion source; and d) about 0.1 to about 100,000 ppm, based on the weight of a), of a cyclodextrin.

The instant compositions provide coatings which are characterized by the presence of tellurium. These coatings generally enhance the resistance to corrosion of treated metallic surfaces and improve the adherence of paints and other coatings to these surfaces. Prior to the application of the instant coatings, the surface to be coated is generally cleaned using some combination of chemical additives, mechanical scrubbing and water rinsing. Conventional conversion coating compositions, such as iron phosphate coating compositions, generally contain metals such as molybdenum, vanadium, nickel and/or tungsten salts to accelerate the coating process and to provide even, adherent coatings.

An essential component of the instant compositions is a cyclodextrin solubilizing agent. Any cyclodextrin can be used. Cyclodextrins may be generally defined as $(C_6H_{10}O_5)_x$, wherein x is a minimum of 6. The preferred cyclodextrins are $\alpha$-(x=6), $\beta$-(x=7), and $\gamma$(x=8) cyclodextrin and the most preferred is -cyclodextrin. Cyclodextrins are commercially available from Amaizo Corporation. The cyclodextrins solubilize tellurium ions over a wide pH range, making it possible to apply tellurium coatings at moderate pH's. In the absence of a cyclodextrin or other solubilizing agent, tellurium is generally insoluble at pH's below about 2.5 and greater than about 11.0.

Optionally, any source of phosphate ions can be used in the instant compositions, including but not limited to phosphoric acid and phosphate salts, such as ammonium, potassium, lithium, or sodium salts of ortho phosphoric acid or pyro phosphoric acid. For example, suitable phosphate salts include but are not limited to mono potassium ortho phosphate, dipotassium ortho phosphate, tripotassium ortho phosphate, mono sodium ortho phosphate, disodium ortho phosphate, trisodium ortho phosphate, hemisodium ortho phosphate, mono ammonium ortho phosphate, diammonium ortho phosphate, triammonium ortho phosphate, lithium ortho phosphate, sodium tripolyphosphate, tetrasodium pyrophosphate, disodium pyrophosphate, sodium hexametaphosphate, sodium ammonium pyrophosphate, sodium octametaphosphate, and sodium heptametaphosphate. The preferred sources of phosphate ions are trimetaphosphates, orthophosphates, hexametaphosphates and tripolyphosphates. The most preferred phosphate ion source is sodium trimetaphosphate. The instant coating compositions may contain from about 0.1 up to about 400,000 ppm, based on the total water in the coating composition, of phosphate ions, on an active basis. Preferably, these compositions contain about 1 to about 200,000 ppm of phosphate ions. It is believed that phosphate ions assist in maintaining tellurium solubility. The phosphates may also act as chelants and sludge reducers.

The instant coating compositions may optionally contain about 0.1 to about 200,000 ppm of an oxidizer, based on weight of water in the coating composition. Preferably, they contain about 1.0 to about 100,000 ppm of an oxidizer. Any oxidizer can be used. The preferred oxidizers are selected from the group consisting of chlorate and nitrate salts. The most preferred oxidizers are sodium chlorate and sodium nitrate.

The instant coating compositions contain at least about 0.1 ppm of tellurium ions (on an active basis) with the upper limit set by tellurium solubility, based on the weight of water in the coating composition. Preferably about 0.1 to about 100,000 ppm, and most preferably about 1 to about 50,000 ppm of tellurium ions are present. Any source of tellurium ions may be used. Preferred tellurium ion sources are the oxides of tellurium and salts of telluric acid or tellurous acid. The most preferred sources of tellurium ions are tellurium oxide and salts of telluric acid.

The balance of the instant composition is water, though additional agents may be used. For example, acids, surfactants, fluoride ion sources and chelants may also be desirable.

An effective amount of a heavy metal catalyst can also optionally be used in the compositions of the instant invention. Such catalysts include, but are not limited to, compounds of such metals as vanadium, titanium, zirconium, tungsten, and molybdenum. The preferred catalysts are sodium molybdate and ammonium metavanadate. In combination with or in place of these heavy metal catalysts, additional accelerators such as acid-soluble salts of nickel, cobalt, magnesium, sodium and calcium may be utilized in the compositions of the instant invention. Typical anions for these salts include but are not limited to nitrates, nitrites and chlorates.

An effective amount of a chelating agent can also optionally be used in the instant invention. Such agents include, but are not limited to thiourea, diamine tetraacetic acid, and nitriloethylene triacetic acid. The preferred chelant is ethylene diamine tetraacetic acid (hereinafter EDTA). The EDTA component of the composition may be of any suitable grade. For example, commercially available solutions which are 39%, by weight, may be used. It is noteworthy that some acids, such as citric acid and EDTA, are well-known chelants.

The compositions of the present invention must contact the metal being treated for an effective amount of time. As used herein, "effective amount of time" means that amount of time required for the composition to contact and to react with the metallic surface being treated so as to produce a uniform, adherent coating. Preferably, the contact time should be about 1-60 minutes, more preferably about 1-30 minutes and most preferably, about 1-5 minutes. Contact between the coating composition and the metal surface can be made to occur by any known method, including but not limited to spraying and immersion techniques. While application temperature is not believed to be critical, a practical upper limit is the boiling temperature of the aqueous coating composition. However, the preferred contact temperature is less than about 120° F.

A preferred composition comprises:

| | Weight Percent (Active Basis) |
|---|---|
| α-cyclodextrin | 2-20 |
| Phosphate Ion Source | 1-20 |
| Oxidizer | 0.5-10 |
| Tellurium | 0.01-3 |
| Water | Balance |

Optionally, the compositions of the present invention may contain about 0.1% to 5%, by weight, of a heavy metal catalyst and about 0.1% to 10%, by weight, of a chelating agent. Also, at least 0.1, by weight, preferably about 0.1% to about 10%, by weight, of a fluoroborate compound may be used to provide fluoride ions to etch the metallic surface being treated.

The compositions of the instant invention may be prepared by conventional mixing or blending techniques in a mix tank. Agitation is desirable. Order of addition is not believed to be critical. However, the cyclodextrin and the tellurium ion source should generally be added prior to any pH adjustment step.

The compositions of the instant invention may be applied to a metallic surface by any known method of application including but not limited to spray and immersion techniques. Optionally, the coating composition can then be rinsed and allowed to dry, which leaves the coating behind.

The process described herein may be followed by or may additionally comprise other steps conventionally used in preparing metallic surfaces for painting, including but not limited sealing the coated metallic surface with chromic or non-chromic based materials.

EXAMPLE

The following example further demonstrates the instant invention. This example is not, however, intended to limit the inventor in any way.

Tellurium-Based Phosphatizer Using Cyclodextrin

| Ingredient | Weight Percent of Composition |
|---|---|
| Water | 83.72 |
| Sodium Hydroxide (50%) | 8.00 |
| Tellurium Dioxide | 0.48 |
| β-Cyclodextrin | 2.4 |
| Sodium Trimetaphosphate | 10.8 |

The above ingredients were added in the order they are listed. This resulted in a clear, stable solution having a pH of 12.63. The pH was then adjusted to pH 11.0 using HCl, and the solution remained clear.

What is claimed is:

1. A composition for applying a coating to a metallic surface comprising:

a) water;

b) about 0.1 to about 400,000 ppm, based on the weight of a), of phosphate ions;

c) about 0.1 to about 100,000 ppm, based on the weight of a), of tellurium ions;

d) about 0.1 to about 100,000 ppm, based on the weight of a), of a cyclodextrin.

2. The composition of claim 1, wherein the pH of said composition is adjusted to the mid-pH range.

3. The composition of claim 1, wherein said cyclodextrin is β-cyclodextrin.

4. The composition of claim 2, wherein said cyclodextrin is β-cyclodextrin.

5. A method for applying a coating to a metallic surface which comprises:

A) contacting said metallic surface with an effective amount of an aqueous coating composition which comprises:

a) water;

b) about 0.1 to about 100,000 ppm, based on the weight a) of tellurium ions;

c) about 0.1 to about 100,000 ppm, based on the weight of a) of a cyclodextrin;

d) optionally, about 0.1 to about 400,000 ppm, based on a) of phosphate ions; and B) Optionally, rinsing and drying said metallic surface.

6. The method of claim 5, wherein said composition is in the mid-pH range.

7. The method of claim 5, wherein said cyclodextrin is β-cyclodextrin.

8. The method of claim 6, wherein said cyclodextrin is β-cyclodextrin.

* * * * *